US008624146B2

(12) United States Patent
Kuhl et al.

(10) Patent No.: US 8,624,146 B2
(45) Date of Patent: Jan. 7, 2014

(54) METAL-ENCAPSULATED, GAS-INSULATED, COMBINED SWITCH DISCONNECTOR AND EARTHING SWITCH

(75) Inventors: Daniel Kuhl, Frankfurt (DE); Michael Mann, Alzenau (DE); David Saxl, Zürich (CH)

(73) Assignee: ABB Technology AG, Zürich (CH)

( * ) Notice: Subject to any disclaimer, the term of this patent is extended or adjusted under 35 U.S.C. 154(b) by 0 days.

(21) Appl. No.: 13/552,062

(22) Filed: Jul. 18, 2012

(65) Prior Publication Data

US 2013/0032575 A1 Feb. 7, 2013

Related U.S. Application Data

(63) Continuation of application No. PCT/EP2011/050554, filed on Jan. 17, 2011.

(51) Int. Cl.
*H01H 33/70* (2006.01)

(52) U.S. Cl.
USPC ..... 218/79

(58) Field of Classification Search
USPC ..... 218/43, 80, 120, 153; 200/507
See application file for complete search history.

(56) References Cited

U.S. PATENT DOCUMENTS

| | | | | |
|---|---|---|---|---|
| 3,665,135 | A | 5/1972 | Boersma et al. | |
| 3,886,336 | A | 5/1975 | Boersma et al. | |
| 4,876,417 | A | 10/1989 | Niederhuefner et al. | |
| 5,625,179 | A | 4/1997 | Bleiker et al. | |
| 5,721,412 | A * | 2/1998 | Schifko et al. | 218/43 |
| 5,828,025 | A | 10/1998 | Neumaier et al. | |
| 6,946,613 | B2 * | 9/2005 | Otsuka et al. | 218/79 |
| 7,122,759 | B2 * | 10/2006 | Moser et al. | 218/79 |
| 7,391,605 | B2 * | 6/2008 | Sologuren-Sanchez et al. | 361/612 |
| 7,432,465 | B2 * | 10/2008 | Pavlovic et al. | 218/79 |
| 7,479,612 | B2 * | 1/2009 | Waldi et al. | 200/507 |
| 2001/0025828 | A1 * | 10/2001 | Gutalj | 218/79 |
| 2007/0278080 | A1 | 12/2007 | Waldi et al. | |
| 2012/0120560 | A1 | 5/2012 | Zwicky et al. | |

FOREIGN PATENT DOCUMENTS

| | | | |
|---|---|---|---|
| DE | 2414200 | A1 | 10/1975 |
| DE | 3802394 | A1 | 8/1989 |
| EP | 0678952 | A1 | 10/1995 |
| EP | 0824264 | B1 | 10/2002 |
| EP | 2254135 | A1 | 11/2010 |
| JP | 2000-134733 | A | 5/2000 |
| WO | WO 2005/050685 | A1 | 6/2005 |

OTHER PUBLICATIONS

*International Search Report (PCT/ISA/210) issued on Apr. 29, 2011, by the Japanese Patent Office as the International Searching Authority for International Application No. PCT/EP2011/050554.

* cited by examiner

*Primary Examiner* — Truc Nguyen
(74) *Attorney, Agent, or Firm* — Buchanan Ingersoll & Rooney PC

(57) ABSTRACT

An exemplary switch having a housing that includes one contact bolt per phase. Each contact bolt moving along a longitudinal axis. In a first position on the axis, the contact bolt connects two active parts to one another. In a second position on the axis, the contact bolt is connected to a fixed earthing contact piece. A drive motor actuates the contact bolts via a drive spindle. The lines of movement of each contact bolt all phases lie in a common plane, wherein each contact bolt is driven by one insulating spindle, which is aligned with the line of movement. The drive spindle lies in the plane of the lines of movement and runs perpendicular to the insulating spindles and is coupled to each insulating spindle via a respective deflecting gear mechanism. The deflecting gear mechanism for the drive of the contact bolts is accommodated in the earthing contact pieces.

8 Claims, 2 Drawing Sheets

METAL-ENCAPSULATED, GAS-INSULATED, COMBINED SWITCH DISCONNECTOR AND EARTHING SWITCH

RELATED APPLICATION

This application claims priority as a continuation application under 35 U.S.C. §120 to PCT/EP2011/050554, which was filed as an International Application on Jan. 17, 2011 designating the U.S., and which claims priority to German Application 10 2010 004 981.6 filed in Germany on Jan. 18, 2010. The contents of these applications are hereby incorporated by reference in their entireties.

FIELD

The disclosure relates to a metal-encapsulated, gas-insulated, combined, polyphase, such as a three-phase switch disconnector and earthing switch, which is accommodated in a housing.

BACKGROUND

A combined switch disconnector and earthing switch for a metal-encapsulated, gas-insulated high-voltage switchgear assembly is disclosed in EP 0 824 264 B1. The contact bolt for each phase is mounted displaceably in a housing element, wherein the lines of movement of the contact bolts run parallel to one another. The contact bolt is driven via a drive spindle, which is in the form of a rack-and-pinion gear and meshes with a rack section onto the contact bolt. The lines of movement of the contact bolts run at an angle of approximately 40° in relation to the connecting conductors between two flanges.

DE 24 14 200 A 1 discloses a metal-encapsulated switchgear assembly, in which a contact bolt is capable of moving to and fro within a carrier housing, wherein the contact bolt is connected to an active part in one position and to an earthing contact in a second position. The contact bolt is driven via a spindle, which runs parallel to the contact bolt, is capable of rotating and has an outer thread. An arm including a through-hole with an inner thread is fitted on the contact bolt perpendicular thereto, wherein the rotatable spindle passes through said arm, wherein the threaded rod is driven by an insulator, which is aligned therewith, or is set in rotation via rack-and-pinion gears from the longitudinal side of the combined switch disconnector and earthing switch. This switchgear assembly is a single-phase-encapsulated switchgear assembly.

A similar construction of a metal-encapsulated switchgear assembly has also been disclosed in U.S. Pat. No. 3,665,135.

EP 0 678 952 A1 describes a combined switch disconnector and earthing switch, which are both actuated separately from one another, however.

SUMMARY

An exemplary metal-encapsulated, gas-insulated, combined, polyphase, three-phase switch disconnector and earthing switch is disclosed. The switch comprising: a housing; a contact bolt per phase of the switch, wherein each contact bolt is configured to move along a longitudinal axis, and in a first position, connects two active parts of the switch to one another, and in a second position, is connected to a fixed earthing contact piece; and a drive motor that actuates the contact bolts via a drive spindle; wherein the lines of movement of the contact bolts of all phases lie in one plane, and contact bolts are driven by in each case one insulating spindle, the insulating spindle being aligned with the line of movement, and wherein the drive spindle lies in the plane of the lines of movement and runs perpendicular to the insulating spindles and is coupled thereto via in each case one deflecting gear mechanism, the deflecting gear mechanism for driving the contact bolts being accommodated in the earthing contact pieces.

An exemplary polyphase switch is disclosed, the switch comprising: a plurality of contact bolts, each contact bolt being associated with one phase of the switch and are configured to move along a longitudinal axis, wherein in a first position on the axis, each bolt connects two active parts of the switch to one another, and in a second position on the axis, each contact bolt is connected to a fixed earthing contact piece; a plurality of insulating spindles where each insulating spindle drives one of the contact bolts; and a drive motor that is perpendicular to the plurality of insulating spindles and is coupled to each insulating spindle through a deflecting gear mechanism, wherein the contact bolts have lines of movement that lie in a common plane, the insulating spindle is aligned with the line of movement, and the drive spindle lies in the plane of the lines of movement, and wherein the deflecting gear mechanism for driving the contact bolts are accommodated in the earthing contact pieces.

DESCRIPTION OF THE DRAWINGS

The disclosure and further exemplary configurations and improvements of the disclosure and further advantages will be explained in more detail and described with reference to the drawing, which illustrates an exemplary embodiment of the disclosure schematically and in which.

DETAILED DESCRIPTION

Exemplary embodiments of the present disclosure provide a combined switch disconnector and earthing switch of the type mentioned at the outset, in which the physical size is reduced and the actuation of the contact bolts is simplified.

According to exemplary embodiments of the disclosure, therefore, the lines of movement of the sliding contact bolts are located in one plane, wherein the sliding contact bolts can be driven by in each case one insulating spindle, which is aligned with the lines of movement of said sliding contact bolts; in this case, the drive spindle lies in the plane of the lines of movement and is coupled to the insulating spindles via in each case one deflecting gear mechanism, wherein the deflecting gear mechanisms for driving each contact bolt are accommodated in the earthing contact pieces.

In an exemplary embodiment, the deflecting gear mechanism is a bevel gear, whose bevel wheels are accommodated and mounted in the respective earthing contact piece.

In another exemplary embodiment of the disclosure the insulating spindles each have an outer thread, which engages in an inner thread of in each case one contact bolt, wherein each contact bolt is impeded in terms of a rotation, with the result that, when the insulating spindles rotate, the contact bolts are shifted in one direction or the other.

The transmission ratio at the deflecting gear mechanism is a 1:1 transmission ratio, with the result that, when the drive spindle rotates, the insulating spindle also rotates in the same way. It is possible to draw a direct conclusion from observing the drive spindle on the movement of the insulating spindle with a scale of 1 to 1. If, in addition, the drive region in front of the drive spindle is also included, where there is also the transmission ratio of 1:1, it is possible to draw a direct conclusion on the movement of the insulating spindle from the movement of the starting point, for example a drive motor.

This enables suitable positioning of auxiliary switches and other assemblies on the drive side and it is therefore possible for these to be used in a simple manner for indicating the situation on the output drive side, i.e. the insulating spindle and therefore the contact bolt.

Figure 1:
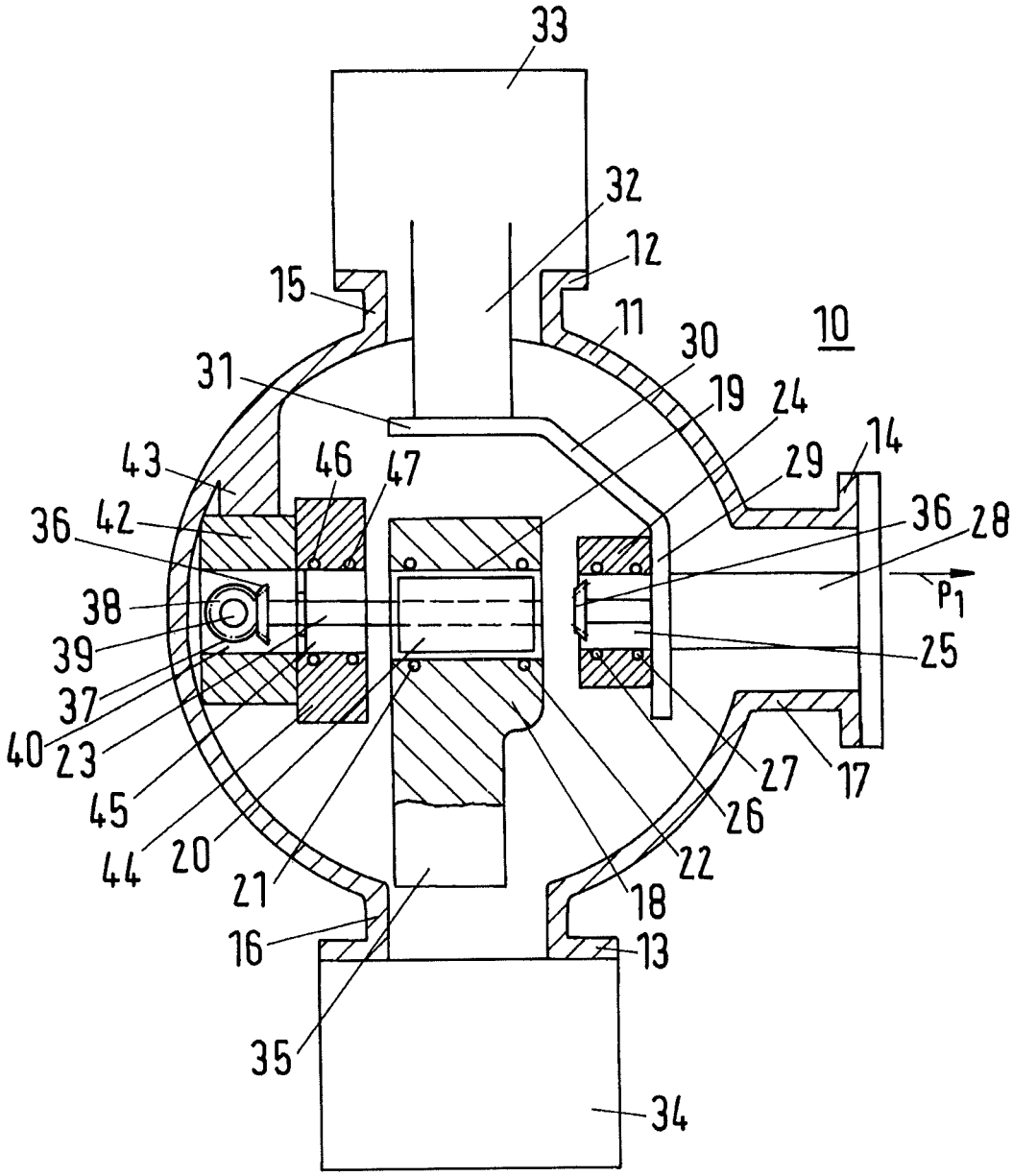
FIG. 1 shows a sectional view through a combined switch disconnector and earthing switch in accordance with an exemplary embodiments of the present disclosure.

FIG. 1 shows a sectional view through a combined switch disconnector and earthing switch in accordance with an exemplary embodiments of the present disclosure.

The combined, metal-encapsulated, three-phase switch disconnector and earthing switch 10 shown in FIG. 1, also referred to below as combined disconnector and earthing switch, has a cylindrical housing 11, on which in each case one flange 12 and 13 are integrally formed distally opposite one another, the flange planes thereof running parallel to one another.

The flange plane of a third flange 14 runs perpendicular to the flange planes, wherein the flanges 12, 13 and 14 are each integrally formed on connectors 15, 16 and 17.

A first active part 18, in which a through-bore 19 is introduced having a mid-axis running parallel to the flange planes 12 and 13 and aligned approximately with the mid-axis of the connector 17 or the flange 14, is located in the interior of the housing 11. A contact bolt 20, which is in the form of a sliding contact bolt, also referred to as contact bolt for short, is formed within the through-bore 19 and is electrically conductively connected, via sliding contact elements 21 and 22, to the active part 18, which can also be referred to as the carrier part for the contact bolt 20. The sliding contact bolt 20 is impeded from rotating by suitable means, for example by lateral longitudinally running flattened portions or else by a tongue-and-groove arrangement; it only moves linearly along its line of movement, which is also the mid-longitudinal axis of the contact bolt 20.

An insulating spindle 23, which is connected to the contact bolt 20, adjoins that end face of the contact bolt 20 which is opposite the flange 14, wherein the insulating spindle 23 bears an outer thread, which meshes with an inner thread (not illustrated) within the contact bolt 20. A second active part 24, which has an inner bore 25, with contact elements 26 and 27 corresponding to the contact elements 21 and 22 being arranged on the inner surface of said inner bore 25, is located within the housing 11. The mid-axis of the inner bore 25 is aligned with the mid-axis of the contact bolt 20 and with the mid-axis of the insulating spindle 23. The active part 24 is connected to a partial conductor piece 28, which forms a current path, for example to an outgoer module, in accordance with the arrow direction $P_1$. A limb 29 of an L-shaped connecting conductor 30 is located between the active part 24 and the partial conductor piece 28, the other limb of said connecting conductor running perpendicular to the first limb 29 and parallel to the flange plane of the flange 12 and parallel to the plane in which the lines of movement of the contact bolts lie. The limb 31 adjoins a partial conductor piece 32, which is connected to a transformer module 33, for example, which is fastened on the flange 12.

A further transformer module 34, for example, is fastened on the flange 13 and is connected to the carrier or first active part 18 via an extension part 35.

A first bevel wheel 36 of a bevel gear 37 is fastened at that end of the insulating spindle 23 which is remote from the contact bolt 20 and meshes with a second bevel wheel 38, which is fastened on a drive spindle 39, which lies in the plane in which the lines of movement of the contact bolts 20 lie, wherein the drive spindle 39 runs perpendicular to the insulating spindles 23 and perpendicular to the mid-axis of the contact bolts 20.

Figure 2:
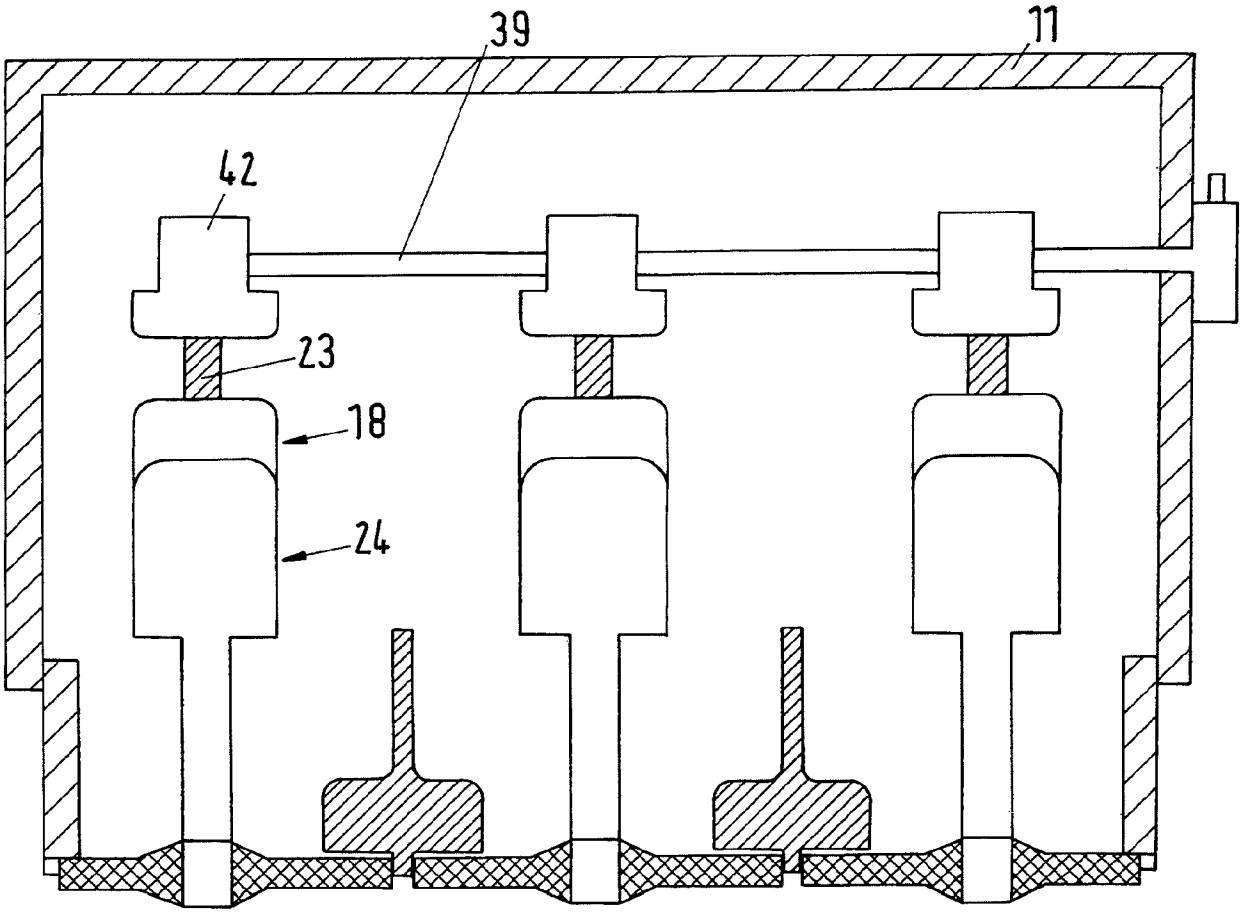
FIG. 2 shows a longitudinal sectional view through the combined switch disconnector and earthing switch shown in FIG. 1 in accordance with an exemplary embodiments of the present disclosure.

FIG. 2 shows a longitudinal sectional view through the combined switch disconnector and earthing switch shown in FIG. 1 in accordance with an exemplary embodiments of the present disclosure. FIG. 2 illustrates a longitudinal sectional view through the housing shown in FIG. 1 with the insulating spindle 23 for each phase. As shown in FIG. 2, the switch disconnector and earthing switch is a three-phase switch. In an exemplary embodiment disclosed herein, the switch disconnector could also be in the form of a two-phase switch, with a single-phase configuration naturally also being conceivable. The arrangement of the contact bolts 20 and the insulating spindles 23 with the earthing contact piece 42 in one plane would only be expedient in a two-phase or three-phase embodiment, however.

The bevel gear is accommodated in the interior 40 of an earthing contact piece 42, which earthing contact piece 42 is fastened on the inner side of the housing 11 via a projection 43. The earthing contact piece 42 has a contact-making element 44, which has an inner bore 45, in which contact elements 46 and 47 corresponding to the contact elements 21, 22; 26, 27 are accommodated.

The contact bolt 20 for each phase is located within the first active part 18, wherein the end faces lie or are located within the end faces of the active part. In order for it to be possible for contact to be made between the contact bolt and the second active part 24, the drive spindle 39 is set in rotation via an electric motor 48, with the result that the insulating spindle 23 is set in rotation via the bevel gear 37, with the result that the contact bolt 20, on rotation in one direction, is driven into the second active part 24 and thus connects the outgoer $P_1$ to the current transformer 34, for example.

In a further mode of operation, when the drive spindle 39 is rotating in the opposite direction, the contact bolt 20 moves in the direction opposite to the arrow direction $P_1$, with the result that the contact bolt can enter the inner bore 45 of the earthing contact piece 42/43 with the end face of said contact bolt, which is on the left in the drawing, with the result that earthing is thus provided.

Instead of fastening the earthing contact piece 42 directly to the inner side of the housing, it is also possible for it to be fastened via a measuring connection device, which is not shown here, however. The combined switch disconnector and earthing switch 10 is flange-connected directly to the circuit breaker housing, in one configuration in a switchgear assembly.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

| List of reference symbols | |
|---|---|
| 10 | Switch disconnector and earthing switch |
| 11 | Cylindrical housing |
| 12 | First flange |
| 13 | Second flange |
| 14 | Third flange |
| 15 | Connector |
| 16 | Connector |
| 17 | Connector |
| 18 | First active part |
| 19 | Through-bore |
| 20 | Contact bolt, sliding contact bolt |
| 21 | Contact elements |
| 22 | Contact elements |
| 23 | Insulating spindle |
| 24 | Second active part |
| 25 | Inner bore |
| 26 | Contact elements |
| 27 | Contact elements |
| 28 | Partial conductor piece |
| 29 | Limb |
| 30 | L-shaped connecting conductor |
| 31 | Limb |
| 32 | Partial conductor piece |
| 33 | Voltage transformer |
| 34 | Current transformer |
| 35 | Extension part |
| 36 | First bevel wheel |
| 37 | Bevel gear |
| 38 | Second bevel wheel |
| 39 | Drive spindle |
| 40 | Interior |
| 42 | Earthing contact piece |
| 43 | Projection |
| 44 | Contact-making element |
| 45 | Inner bore |
| 46 | Contact elements |
| 47 | Contact elements |
| 48 | Electric motor |

What is claims is:

1. A metal-encapsulated, gas-insulated, combined, polyphase, three-phase switch disconnector and earthing switch, comprising:

a housing;

a contact bolt per phase of the switch, wherein each contact bolt is configured to move along a longitudinal axis, and in a first position, connects two active parts of the switch to one another, and in a second position, is connected to a fixed earthing contact piece; and a drive motor that actuates the contact bolts via a drive spindle;

wherein lines of movement of the contact bolts of all phases lie in one plane, and each contact bolt is driven by one insulating spindle, the insulating spindle being aligned with the line of movement; and wherein the drive spindle lies in the plane of the lines of movement and runs perpendicular to the insulating spindles, each insulating spindle being coupled to the drive spindle via one deflecting gear mechanism, the deflecting gear mechanism for driving the contact bolts being accommodated in the earthing contact pieces.

2. The switch disconnector and earthing switch according to claim 1, wherein the deflecting gear mechanism is a bevel gear, whose bevel wheels are accommodated in the respective earthing contact piece.

3. The switch disconnector and earthing switch according to claim 1, wherein each insulating spindle has an outer thread, which engages in an inner thread of a respective contact bolt, wherein each contact bolt is impeded in terms of a rotation, such that when the insulating spindles rotate, the contact bolts are shifted in one direction or the other.

4. A polyphase switch, comprising:

a plurality of contact bolts, each contact bolt being associated with one phase of the switch and are configured to move along a longitudinal axis, wherein in a first position on the axis, each bolt connects two active parts of the switch to one another, and in a second position on the axis, each contact bolt is connected to a fixed earthing contact piece;

a plurality of insulating spindles where each insulating spindle drives one of the contact bolts;

a drive spindle that is perpendicular to the plurality of insulating spindles and is coupled to each insulating spindle through a deflecting gear mechanism, wherein the contact bolts have lines of movement that lie in a common plane, the insulating spindle is aligned with the line of movement, and the drive spindle lies in the plane of the lines of movement, and wherein the deflecting gear mechanism for driving the contact bolts are accommodated in the earthing contact pieces.

5. The switch according to claim 4, wherein the drive motor actuates each contact bolt via a drive spindle.

6. The switch according to claim 4, wherein the deflecting gear mechanism is a bevel gear, whose bevel wheels are accommodated in the respective earthing contact piece.

7. The switch according to claim 4, wherein each insulating spindle has an outer thread that engages in an inner thread of a respective contact bolt, wherein each contact bolt is impeded in terms of a rotation, such that when the insulating spindles rotate, the contact bolts are shifted in one direction or the other.

8. The switch according to claim 4, comprising:

a housing that comprises the plurality of contact bolts, the plurality of insulating spindles, the drive motor, and the deflecting gear mechanism.

* * * * *